United States Patent [19]

Haas et al.

[11] 4,409,086

[45] Oct. 11, 1983

[54] ELECTROLYTIC CELL

[75] Inventors: Günther Haas, Oberursel; Ludolf Plass, Kronberg; Karl Lohrberg, Heusenstamm, all of Fed. Rep. of Germany

[73] Assignee: Metallgesellschaft Aktiengesellschaft, Frankfurt am Main, Fed. Rep. of Germany

[21] Appl. No.: 247,710

[22] Filed: Mar. 26, 1981

[30] Foreign Application Priority Data

Mar. 26, 1980 [DE] Fed. Rep. of Germany ..... 3011643

[51] Int. Cl.[3] ..... C25B 9/04; C25B 11/10; C25B 11/04

[52] U.S. Cl. ..... 204/269; 204/275; 204/279; 204/290 F; 204/292

[58] Field of Search ..... 204/279, 288, 289, 275-278, 204/269, 290 F, 292

[56] References Cited

U.S. PATENT DOCUMENTS 3,192,142 6/1965 Vellas et al. ..... 204/275 X
3,728,245 4/1973 Preis et al. ..... 204/275
3,984,304 10/1976 Rahn ..... 204/288 X
4,134,805 1/1979 Fröhler et al. ..... 204/275 X
4,325,798 4/1982 Mack ..... 204/275 X

*Primary Examiner*—Donald R. Valentine
*Attorney, Agent, or Firm*—Sprung, Horn, Kramer & Woods

[57] ABSTRACT

In electrolytic apparatus comprising cell chambers through which is passed an electrolyte and in which sets of anode plates are provided, each of which are connected to current-feeding center pins, and the mutually staggered electrode plates protrude into the gaps between plates having the opposite polarity. To ensure a simple, quick and reliable installation and removal of the anode plates, the center pin is provided with contact straps, which are spaced apart in the longitudinal direction of the pin and serve to secure the anode plate. The contact straps are suitably spaced about 180° apart and have at least one opening, which consists preferably of a tapped bore.

The electrolytic apparatus is used in processes of producing alkali chlorate by the electrolytic decomposition of aqueous alkali chloride solutions.

8 Claims, 1 Drawing Figure

ELECTROLYTIC CELL

BACKGROUND OF THE INVENTION

1. Field of the Invention

This invention relates to an electrolytic cell comprising a plurality of parallel anodes and cathodes which are closely spaced apart and have confronting surfaces.

2. Discussion of Prior Art

The electrolysis of alkali chloride solutions or acid alkali sulfate solutions to produce alkali chlorates or alkali persulfates is usually carried out in electrolytic cells having steel cathodes and titanium anodes. The anodes are usually provided with an activating coating, which consists, e.g., of mixed oxides of platinum metals. In the production of alkali chlorate by an electrolysis of alkali chloride solutions, the titanium of the anode serves to carry electric current and the presence of the activating coating reduces the voltage required for a deposition of chlorine so that energy is saved. The dimensions of the anode material are selected in dependence not only on the current density ($kA/m^2$) but also of the distance to be traversed by the current in the anodes themselves. To ensure a uniform distribution of current over the anodes, the voltage drop in the anodes must be small compared with the voltage drop in the electrolyte. For this reason, the cross-sectional area of the anode material must be relatively large.

It is known to connect titanium anodes at the vertical housing walls of the electrolytic cell in such a manner that the total current is uniformly distributed over the several sheet electrodes and flows across the cell. When the anodes are connected to the cell walls, flanged anodes are commonly used, which are secured to the cell walls by connecting screws or welded joints. It is known from German Auslegeschrift 26 45 121 that current may be centrally fed to the anodes by means of a so-called center electrode consisting of a current-feeding pin provided on the vertical center line of the anodes. The length of the path along which the current must flow is thus reduced to one-half so that the thickness of the material can be reduced considerably or to one-half.

While affording this advantage and resulting in a suitable, compact structure, the previously known design involves considerable difficulties regarding the assembling of the anode set. Additionally, losses are involved in the flow of current from the copper pin over the female screw threads of the threaded sleeve and the male screw threads of the sleeve to the threaded rings. Each anode plate is individually and loosely fitted on current-feeding threaded sleeves and is fixed by means of individual threaded rings, which serve also as spacers. The electric contact is established by a pressure contact joint. This operation is repeated until the desired number of anode plates have been mounted. In that method, particularly high costs are due to the need for platinizing the contacting surfaces of the anode and of the threaded rings and the threaded sleeves carried by the current-feeding pins, in order to ensure that the voltage drop at the interfaces will always be low. In another embodiment of the known electrolytic cell, the current-feeding threaded sleeves may have annular ribs, which have the same thickness as the anode plates. The diameter of the ring only slightly exceeds the opening in the anode plate so that the ring is almost flush with the anode plate. That ring is fixed by a welded joint.

It is an object of the invention to eliminate the above-mentioned disadvantages and to provide for an electrolytic cell an anode assembly which can be assembled simply and in an economical manner.

SUMMARY OF THE INVENTION

For this purpose, the invention provides an electrolytic apparatus comprising cell chambers which are passed through by the electrolyte and in which sets of anode plates are provided, each of which is disposed between two sets of cathode plates and which are connected to current-feeding center pins, and the mutually staggered electrode plates protrude into the gaps between plates having the opposite polarity. In an electrolytic apparatus of the kind described, the invention resides in that the center pin is provided with contact straps, which are spaced apart in the longitudinal direction of the pin and serve to secure the anode plate.

The contact straps can have a size of e.g., $20\times10\times10$ mm and can be mounted on, and preferably welded to, the titanium coating of the center pin and are spaced at least 90° and suitably about 180° apart and spaced apart along the pin. To permit the anode plates to be secured to the contact straps in a very simple manner so that they can easily be replaced, the contact straps have at least one opening. The opening or openings are suitably circular holes, which consist preferably of tapped bores. The anode plates to be mounted on the contact straps have openings adapted to register with the openings or bores in the contact straps so that an intimate contact between the anode plate and the contact straps can easily be established, e.g., by means of screws. For instance, in a so-called four-pin cell each anode plate has, e.g., at least four bores so that it can be secured, e.g., by screws, at at least the four bores of the associated four contact straps which are carried by the four pins and superimposed in a vertical plane.

Each anode plate is rectangular and has on its vertical center line at least one opening and, for instance, in a four-pin cell, four openings. These openings consist of slots and have a major diameter that extends, e.g., in the vertical center line of the anode plate and is at least as large as the diameter of the coated center pin. In a four-pin cell, each anode plate is then secured by means of four contact straps to four pins, which extend through the slots, so that the anode plates are parallel to each other and equally spaced and extend at right angles to the longitudinal axes of the bolts. A compact set of anodes is thus obtained. The cathodes consist also of sets of cathode plates, which are secured to a carrier plate, on one side thereof, at right angles thereto and are equally spaced and parallel to each other. The carrier plates constitute the side walls of the housing of the electrolytic cell. They are liquid tightly connected to and electrically insulated from the remaining parts of the cell housing. The leads for feeding current are secured to the outside of the carrier plates. All other parts of the cell housing are electrically connected to the anodes.

Whereas all cathode parts consist of steel, the material of all anode portions in contact with the electrolyte, inclusive of the contact straps provided in accordance with the invention, consists of titanium metal. Those surfaces of the contact straps and anodes which form current-conducting interfaces are provided with a platinum coating which has a high electrical conductivity. This means that the effective surface carries a coating of mixed oxides of the platinum metals, particularly the oxides of ruthenium and rhodium.

The current-feeding pin consists of composite material comprising a copper core and a shrunk-on sheath of titanium. At one end of the current feeding pin the latter is secured to the inside surface of the housing by means of an annular flange. For this purpose, the copper core is provided with screw threads, which can be unscrewed. A screw body of copper is inserted through a suitable opening in the carrier wall and with its screw threads is screwed into the screw threads of the copper cores. The free end of the screw body is connected by a current-feeding lead to the positive pole of a voltage source. To assemble the set of anode plates, each anode plate is fitted at the slots over the center pins and the staggered contact straps by a reciprocating movement and when it has reached the desired position is secured by means of screws to the contact straps. When the screws have been fixed, additional plates are installed in the same manner until the desired number of anode plates has been mounted on and connected to the pins.

To assemble the electrolytic cell, through which the electrolyte flows in a vertical direction, the middle set of anode plates is first secured to a carrying grate. The side walls of the cell housing are then removed and the cathodes are secured to the side walls. Finally, the cathodes consisting of sets of cathode plate side walls are inserted together with the side walls to such positions that an anode and cathode lie opposite to each other in the cell.

The electrolytic apparatus according to the invention can be used to advantage in electrolytic processes for producing alkali chlorate by an electrolytic decomposition of aqueous alkali chloride solutions.

The advantages afforded by the invention reside in that the design of the anode assembly according to invention ensures that the anode plates can be installed and removed in a very fast, reliable and economical manner, compared with the use of known welded and pressure contact joints for connecting anode plates to the current-feeding carrier. This is due to the fact that the anode plates are connected only by simple screwed connections to contact straps of the center pin. The fast removal is significant because the anode plates must be removed from the cell at regular intervals in order to be re-activated or re-coated. Because the anode plates contact the contact straps only on relatively small surfaces, much less platinum is required for the platinizing of contact surfaces. The number of current-carrying contacts and, with them, the current losses, are minimized too.

BRIEF DESCRIPTION OF DRAWING

Referring to the annexed drawing, the same is a side elevation, partially in section and partially exploded showing a center pin of the invention for use in an electrolytic cell.

DESCRIPTION OF SPECIFIC EMBODIMENT

Figure 1:
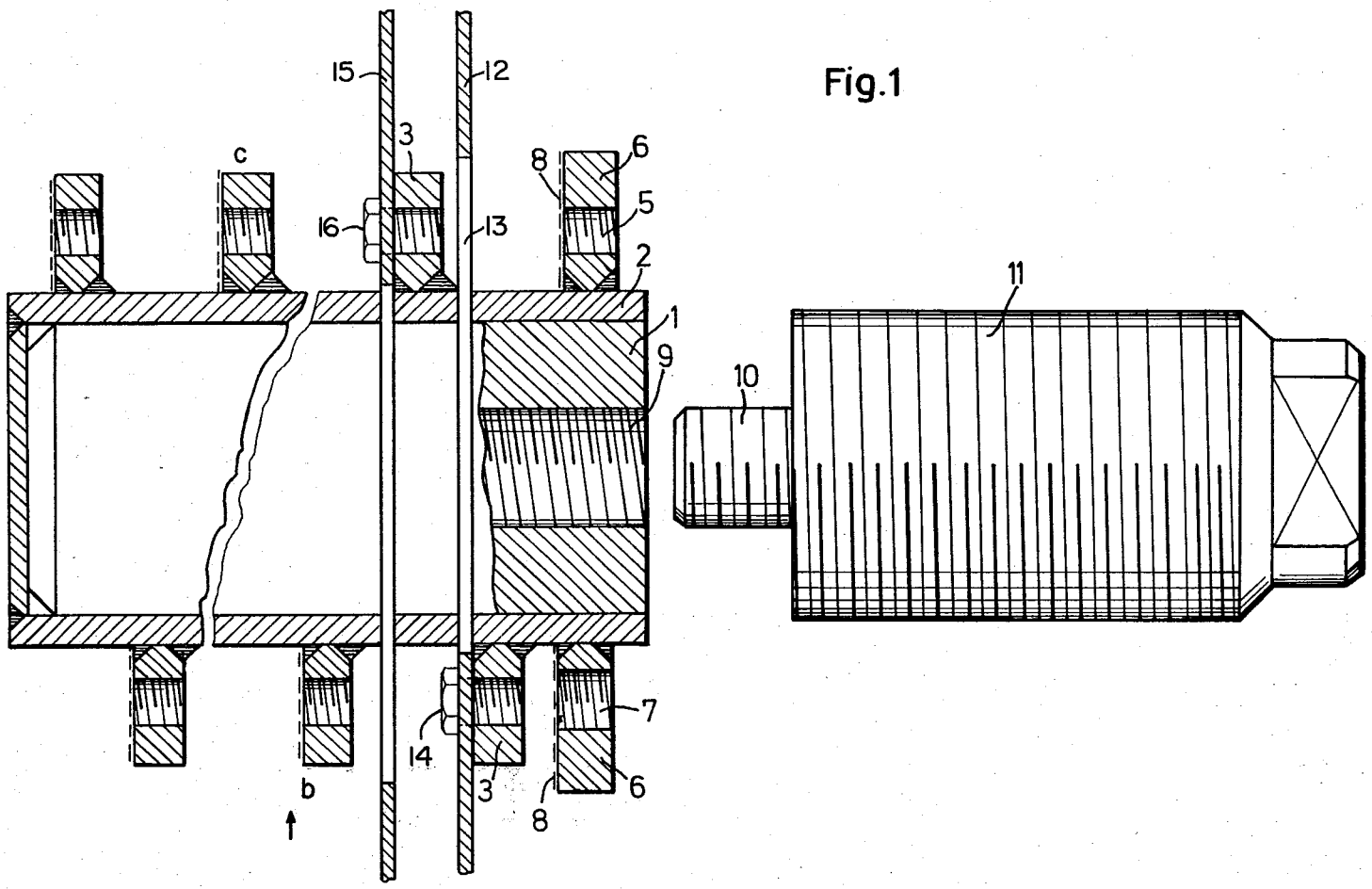

The accompanying drawing shows a center pin according to the invention. The center pin consists of a copper core 1 and a titanium sheath 2 shrunk thereon. Contact straps 3 of titanium have been welded to the titanium sheath 2. Each contact strap 3 has at least one bore 5. At these bores, the anode plates 12 and 15 are screw-connected to the contact straps. Anode plate 12 is screw-connected to contact strap 3 by screw-threaded bolt 14 and anode plate 15 is screw-connected to contact strap 3 by screw-threaded bolt 16. Anode plate 12 is provided with an oblong hole or slot 13. An unscrewed plate (not shown) can be moved to the left over contact bracket b and can be lifted and further moved over bracket c.

The contact strap 3 carries a platinum layer 6 at least on its contact surface. The platinum layer can be in the form of an annular flange 6, which can be welded to the titanium sheath 2. It has bores 5 for the fixation of the anode plate and bores 7 for the fixation of the flange to the inside surface of the housing. The platinum coating on the flange 6 is designated 8. The threaded portion 10 of the screw body 11 is screwed into the tapped hole 9 of the copper core 1.

What is claimed is:

1. In an electrolytic apparatus comprising a cell chamber and means for passing an electrolyte therethrough, said cell provided with sets of anode plates, each of which is disposed between two sets of cathode plates and each of which is connected to a current-feeding center pin, said anode plates being mutually staggered electrode plates which protrude into the gaps between plates having the opposite polarity, the improvement wherein said center pin is provided with laterally disposed contact straps, which are spaced apart in the longitudinal direction of the pin, each of said straps having an anode plate secured thereto.

2. Electrolytic apparatus according to claim 1, wherein the contact straps are spaced about 180° apart.

3. Electrolytic apparatus according to claim 1, wherein each contact strap has at least one opening bore.

4. Electrolytic apparatus according to claim 3, wherein said opening comprises a tapped bore.

5. Electrolytic apparatus according to claim 1, wherein said center pin comprises a core of copper having a high electrical conductivity and a shrunk-on sheath of titanium.

6. Electrolytic apparatus according to claim 1, wherein the contact straps comprise platinized titanium.

7. An electrolytic apparatus according to claim 1 wherein said anode comprises titanium.

8. An electrolytic apparatus according to claim 1 wherein said cathode comprises steel.

* * * * *